US008734127B2

(12) United States Patent
Iida

(10) Patent No.: US 8,734,127 B2
(45) Date of Patent: May 27, 2014

(54) HYDRAULIC PUMP-MOTOR AND METHOD OF PREVENTING PULSATION OF HYDRAULIC PUMP-MOTOR

(75) Inventor: Takeo Iida, Koga (JP)

(73) Assignee: Komatsu Ltd., Tokyo (JP)

( * ) Notice: Subject to any disclaimer, the term of this patent is extended or adjusted under 35 U.S.C. 154(b) by 662 days.

(21) Appl. No.: 12/733,744

(22) PCT Filed: Sep. 9, 2008

(86) PCT No.: PCT/JP2008/066257

§ 371 (c)(1),
(2), (4) Date: Mar. 18, 2010

(87) PCT Pub. No.: WO2009/037994

PCT Pub. Date: Mar. 26, 2009

(65) Prior Publication Data

US 2010/0236398 A1 Sep. 23, 2010

(30) Foreign Application Priority Data

Sep. 19, 2007 (JP) ..... 2007-243099

(51) Int. Cl.
*F04B 1/12* (2006.01)

(52) U.S. Cl.
USPC ..... 417/269; 417/270; 417/560; 91/499; 91/505; 91/506

(58) Field of Classification Search
USPC ..... 417/269, 270, 560; 91/499, 505, 506
See application file for complete search history.

(56) References Cited

U.S. PATENT DOCUMENTS 5,572,919 A * 11/1996 Ishizaki ..... 91/499
5,593,285 A * 1/1997 Watts ..... 417/269

(Continued)

FOREIGN PATENT DOCUMENTS

DE 19706114 A1 8/1998
DE 10232983 A1 2/2004

(Continued)

OTHER PUBLICATIONS

German Office Action issued May 23, 2013 in corresponding German Patent Application No. 11 2008 002 255.0 (English translation provided).

(Continued)

*Primary Examiner* — Christopher Bobish
(74) *Attorney, Agent, or Firm* — Edwards Wildman Palmer LLP; James E. Armstrong, IV; George N. Chaclas

(57) ABSTRACT

A pressure regulating restriction for allowing a cylinder bore and a valve plate discharge port to communicate with each other before the cylinder bore communicates with the valve plate discharge port, and an oil passage for allowing the valve plate discharge port and the cylinder bore to temporarily communicate with each other in a time period after the cylinder bore is freed from the communication with the valve plate suction port until the cylinder bore communicates with the pressure regulating restriction. The oil passage has length capable of transmitting high pressure in the oil passage on a side of the cylinder bore at the time of the communication and of restoring the pressure in the oil passage on the side of the cylinder bore to the pressure on a side of the valve plate discharge port before the communication with a next cylinder bore at the time of non-communication.

16 Claims, 12 Drawing Sheets

(56) References Cited

U.S. PATENT DOCUMENTS

| | | | | |
|---|---|---|---|---|
| 6,086,336 | A | 7/2000 | Welschof et al. | |
| 7,585,158 | B2 * | 9/2009 | Zeiser | 417/271 |
| 8,128,380 | B2 * | 3/2012 | Guggemos et al. | 417/273 |
| 2005/0180872 | A1 * | 8/2005 | Esders | 417/509 |
| 2006/0096558 | A1 | 5/2006 | Zeiser | |

FOREIGN PATENT DOCUMENTS

| | | | |
|---|---|---|---|
| DE | 102004007933 | B3 | 6/2005 |
| JP | 47-33083 | B1 | 8/1972 |
| JP | 59-007786 | | 1/1984 |
| JP | 59-11755 | B2 | 3/1984 |
| JP | 07-180654 | | 7/1995 |
| JP | 07-189887 | | 7/1995 |
| JP | 08-144941 | | 6/1996 |
| JP | 08-210242 | | 8/1996 |
| JP | 09-256945 | | 9/1997 |
| JP | 2006-046150 | A | 2/2006 |

OTHER PUBLICATIONS

J. Ivantysyn et al., "Hydrostatische Pumpen und Motoren", Konstruction und Berechnung, Dr.-Ing. Jaroslav Ivantysyn.

* cited by examiner

HYDRAULIC PUMP-MOTOR AND METHOD OF PREVENTING PULSATION OF HYDRAULIC PUMP-MOTOR

CROSS-REFERENCE TO RELATED APPLICATION

This application is the U.S. national phase, pursuant to 35 U.S.C. §371, of international application No. PCT/JP2008/066257 published in Japanese on Mar. 26, 2009 as international publication No. WO 2009/037994 A1, which claims the benefit of Japanese Patent Application Ser. No. 2007-243099, filed Sep. 19, 2007, the disclosure of which applications are incorporated herein in their entireties by this reference.

TECHNICAL FIELD

The present invention relates to an axial hydraulic pump-motor capable of inhibiting pulsation generated when a process shifts from a low-pressure process to a high-pressure process from being generated and a method of preventing the pulsation of the axial hydraulic pump-motor.

BACKGROUND ART

Conventionally, in a construction machine and the like, an axial hydraulic piston pump driven by an engine and an axial hydraulic piston motor driven by pressure oil are widely used.

For example, the axial hydraulic piston pump is provided so as to integrally rotate with a rotational axis rotatably provided in a case and has a cylinder block in which a plurality of cylinders elongating in an axial direction are formed so as to be spaced apart in a circumferential direction, a plurality of pistons each of which is slidably inserted into each cylinder of the cylinder block to move in the axial direction in association with rotation of the cylinder block to suck and discharge operating oil, and a valve plate provided between the case and an end face of the cylinder block in which a suction port and a discharge port communicating with each cylinder are formed. Then, in the hydraulic pump, when a drive shaft rotate-drives, the cylinder block rotates together with an operating shaft in the case, the piston reciprocates in each cylinder of the cylinder block and the operating oil sucked from the suction port into the cylinder is pressurized by the piston and is discharged to the discharge port as the pressure oil.

Herein, when a cylinder port of each cylinder communicates with the suction port of the valve plate, a suction process in which the piston moves in a direction to protrude from the cylinder from a start point to an end point of the suction port to suck the operating oil from the suction port into the cylinder is performed. On the other hand, when the cylinder port of each cylinder communicates with the discharge port, a discharge process in which the piston moves in a direction to approach in the cylinder from a start point to an end point of the discharge port to discharge the operating oil in the cylinder to the discharge port is performed. Then, by rotating the cylinder block so as to repeat the suction process and the discharge process, the operating oil sucked from the suction port into the cylinder in the suction process is pressurized and discharged to the discharge port in the discharge process.

Patent Document 1: Japanese Laid-Open Patent Application Publication No. H07-189887

Patent Document 2: Japanese Laid-Open Patent Application Publication No. H08-144941

DISCLOSURE OF INVENTION

Problem to be Solved by the Invention

In the above-described conventional hydraulic pump and the like, an inside of the cylinder, which sucks the operating oil through the suction port of the valve plate in the suction process, is in a low-pressure state, and when the cylinder port of each cylinder communicates with the discharge port, there is a problem that the highly pressurized pressure oil in the discharge port drastically flows into the cylinder in a low-pressure state through the cylinder port and generates large pressure fluctuation, the pulsation is generated by the pressure fluctuation, and oscillation and noise are generated as a result.

In order to solve the problem, in the Patent Document 1, a first notch groove communicating with the cylinder port when communication between the cylinder port located on an end point side of the suction port out of the cylinder port of each cylinder and the suction port is interrupted is provided on the valve plate. Also, a second notch groove communicating with the cylinder port when communication between the cylinder port located on an end point side of the discharge port and the discharge port is interrupted is provided. Then, the hydraulic pump inhibits the pulsation generated by the pressure fluctuation from being generated by continuous communication between the first and second notch grooves through a communication passage.

Also, in the Patent Document 2, a notch is formed on an approach side of the cylinder port of the discharge port and a conduit extending from a space between the notch and the suction port in front of the same to the discharge port is formed, and a chamber is provided in the middle of the conduit. Further, a check valve for allowing fluid to flow from the discharge port to the chamber is provided on the conduit on a portion connecting the discharge port and the chamber. According to this, in the hydraulic pump, high pressure is supplied from the chamber to the cylinder before the cylinder port reaches the discharge port, decrease in pressure of the chamber is replenished from the discharge port through the check valve, and generation of the pulsation in the discharge port due to a counter flow of highly pressurized fluid from the discharge port into the cylinder when the cylinder port directly communicates with the discharge port is reduced.

However, in the Patent Document 1, although the pressure in the cylinder is increased before the cylinder port communicates with the discharge port, the increase in pressure is only by residual pressure in a high-pressure side cylinder, so that the increase in pressure is not sufficient and this is the increase in pressure of approximately a one-third of the differential pressure, for example, and as a result, since difference between the cylinder inner pressure and the pressure on a discharge port side is large, there is a problem that the highly pressurized fluid counterflows into the cylinder at the time of communication with the discharge port and the pulsation is generated on the discharge port side depending on the rotational number.

Also, although the chamber and the check valve are provided in the Patent Document 2, in this configuration, the configuration itself is complicated and there is a problem that the highly pressurized fluid counterflows into the cylinder at the time of the communication with the discharge port and the pulsation is generated on the discharge port side depending on the rotational number, as in the case of the Patent Document 1.

The present invention is made in consideration of the above description, and an object thereof is to provide the hydraulic pump-motor capable of inhibiting the pulsation in a relatively wide rotational number region with a simple configuration and the method of inhibiting the pulsation of the hydraulic pump-motor.

Means for Solving Problem

According to an aspect of the present invention, an axial hydraulic pump-motor in which a cylinder block having a plurality of cylinder bores formed about a rotational axis slides relative to a valve plate having a high-pressure side port and a low-pressure side port to control an amount of reciprocation of a piston in each cylinder bore by tilt of a swash plate, includes an oil passage for allowing the high-pressure side port and the cylinder bore to temporarily communicate with each other in a time period after the cylinder bore is freed from communication with the low-pressure side port until the cylinder bore communicates with the high-pressure side port. The oil passage has a length capable of transmitting high pressure in the oil passage on a side of the cylinder bore to the cylinder bore at the time of communication, and of restoring pressure in the oil passage on the side of the cylinder bore to a pressure of a side of the high-pressure side port before communication with a next cylinder bore at the time of non-communication.

Advantageously, in the hydraulic pump-motor, the length of the oil passage is approximately a quarter to a half of a wavelength determined by a speed of pressure transmission and frequency of the cylinder bore determined by a rotational number of the cylinder block.

Advantageously, in the hydraulic pump-motor, a pressure regulating restriction for allowing each cylinder bore to communicate with the high-pressure side port on a position to communicate with the high-pressure side port and through which the cylinder bore passes.

Advantageously, the hydraulic pump-motor further includes a residual pressure loss regeneration circuit for transmitting pressure in the cylinder bore on a side of a top dead center freed from communication with the high-pressure side port to the cylinder bore on a side of a bottom dead center freed from communication with the low-pressure side port in a time period after the cylinder bore is freed from the communication with the low-pressure side port until the oil passage communicates.

Advantageously, in the hydraulic pump-motor, the residual pressure loss regeneration circuit has a residual pressure loss recovery port provided on a side of the valve plate on a side of the top dead center, a residual pressure loss regeneration port provided on a side of the valve plate on a side of the bottom dead center and a communication hole communicating between the residual pressure loss recovery port and the residual pressure loss regeneration port, and the residual pressure loss regeneration port is provided on a position to temporarily communicate with the communication hole after temporal communication between the residual pressure loss recovery port and the communication hole.

Advantageously, in the hydraulic pump-motor, a restriction is provided on the oil passage and/or the residual pressure loss regeneration circuit.

Advantageously, in the hydraulic pump-motor, the oil passage has a volume for buffering the pressure.

Advantageously, in the hydraulic pump-motor, the oil passage is provided in an end cap for holding the valve plate.

Advantageously, in the hydraulic pump-motor, an opening on a side of the cylinder bore of the oil passage and/or the residual pressure loss regeneration circuit is a notch groove and/or an oblique drilled hole provided outside of a sliding area of the cylinder bore and in the vicinity of the cylinder bore except in the vicinity of an outer peripheral side of the cylinder bore.

Advantageously, the hydraulic pump-motor further includes a plurality of oil passages. Each oil passage sequentially communicates in association with rotation of the cylinder block.

According to another aspect of the present invention, a method of preventing pulsation of a hydraulic pump-motor for increasing inner pressure of a cylinder bore shifting from a low-pressure side to a high-pressure side in an axial hydraulic pump-motor in which a cylinder block having a plurality of cylinder bores formed about a rotational axis slides relative to a valve plate having a high-pressure side port and a low-pressure side port to control an amount of reciprocation of a piston in each cylinder bore by tilt of a swash plate, includes a first pressure-increasing step for transmitting high pressure of the high-pressure side port to the cylinder bore on a side of a bottom dead center through an oil passage for allowing the high-pressure side port and the cylinder bore to temporarily communicate with each other.

Advantageously, in the method of preventing pulsation of a hydraulic pump-motor, further includes: a second pressure-increasing step for transmitting high pressure in the cylinder bore on a side of a top dead center freed from communication with the high-pressure side port to the cylinder bore on the side of the bottom dead center freed from communication with the low-pressure side port after the cylinder bore is freed from the communication with the low-pressure side port, before the first pressure-increasing step; and a third pressure-increasing step for transmitting the high pressure of the high-pressure side port to the cylinder bore on the side of the bottom dead center by communicating between the cylinder bore on the side of the bottom dead center and the high-pressure side port in a time period after the first pressure-increasing step until the cylinder bore on the side of the bottom dead center communicates with the high-pressure side port.

Effect of the Invention

The hydraulic pump-motor and the method of inhibiting the pulsation of the hydraulic pump-motor according to the present invention are such that the oil passage for allowing the high-pressure port and the cylinder bore to temporarily communicate with each other in a time period after the cylinder bore is freed from communication with the low-pressure side port until the cylinder bore communicates with the high-pressure port is provided, and the oil passage has length capable of transmitting the high pressure in the oil passage on the side of the cylinder bore into the cylinder bore at the time of communication and of restoring the pressure in the oil passage on the side of the cylinder bore to the pressure on the side of the high-pressure side port before the communication with the next cylinder bore at the time of non-communication. By the oil passage, the high pressure on the high-pressure side port is transmitted to the cylinder bore to unidirectionally increase the cylinder bore inner pressure up to around the high-pressure state of the high-pressure side port. Therefore, the counter flow from the side of the high-pressure side port may be made smaller when the cylinder bore communicates with the pressure regulating restriction, thereby inhibiting the pulsation in the relatively wide rotational number region with the simple configuration as a result.

EXPLANATIONS OF LETTERS OR NUMERALS

Figure 1:
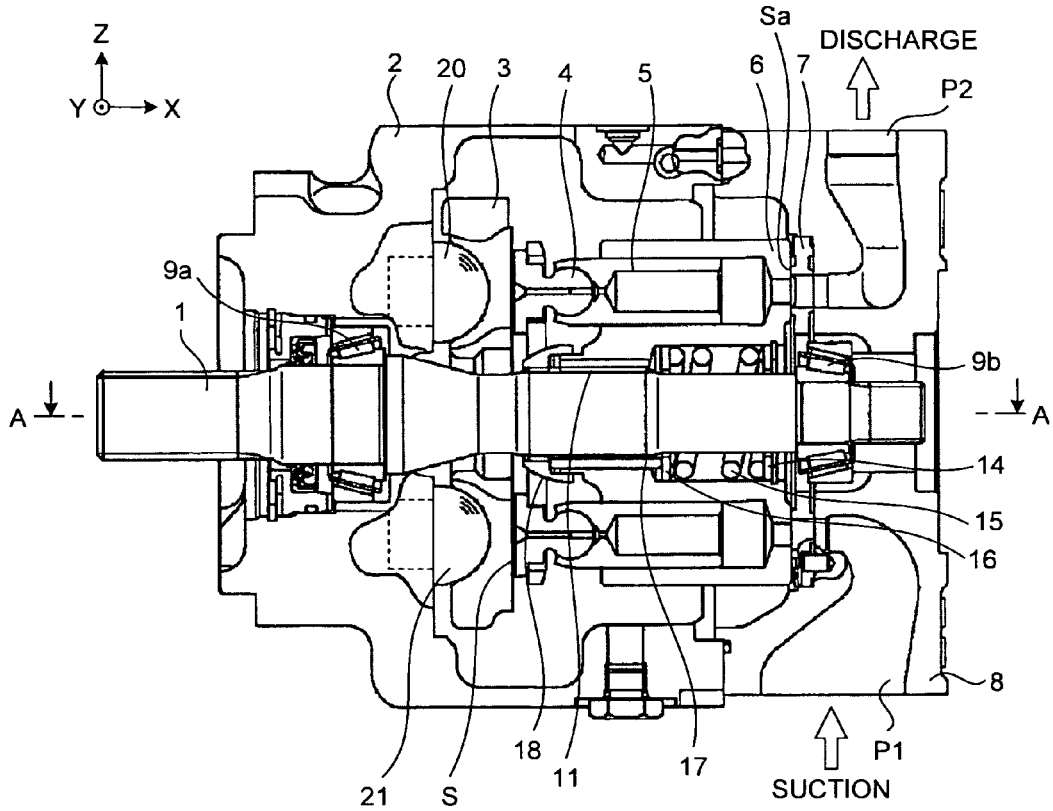
FIG. 1 is a cross-sectional view showing a schematic configuration of a hydraulic pump according to an embodiment of the present invention.

1 shaft
2 case
3 swash plate
4 shoe
5, 10 piston
6 cylinder block
7 valve plate
8 end cap
9, 9*a* bearing
11 spline structure
14 ring
15 spring
16 movable ring
17 needle
18 pressing member
20, 21 bearing
25, 25*a* to 25*i* cylinder bore
30 residual pressure loss regeneration circuit
31 residual pressure loss recovery port
32 residual pressure loss regeneration port
33, 33*a* to 33*i* residual pressure loss port
34, 53, 62 drilled hole
40, 50, 60 oil passage circuit
42 oil passage port
43, 43*a* to 43*i* notch groove
51, 53 restriction
52 pressure regulating restriction
61 drain port
63 volume
P1 suction port
P2 discharge port
PB1 valve plate suction port
PB2 valve plate discharge port
S, Sa sliding surface

BEST MODE(S) FOR CARRYING OUT THE INVENTION

Hereinafter, a hydraulic pump-motor and a method of inhibiting pulsation of the hydraulic pump-motor being a best mode for carrying out the present invention are described with reference to drawings.

Figure 2:
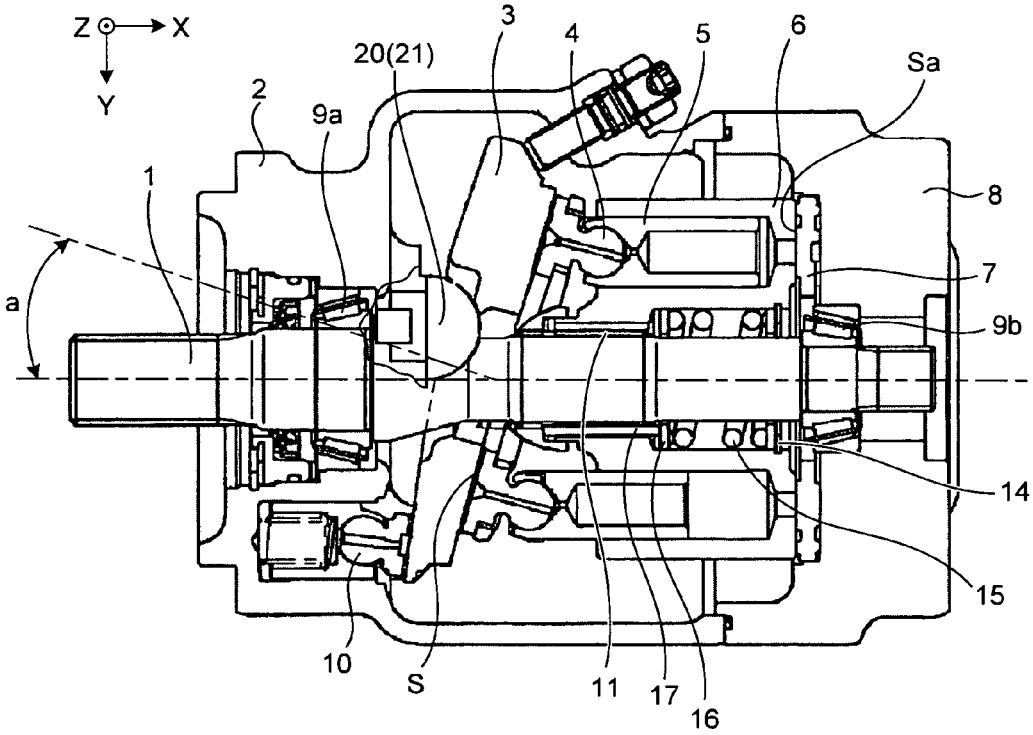
FIG. 2 is a cross-sectional view taken along a line A-A of the hydraulic pump shown in FIG. 1.

FIG. 1 is a cross-sectional view showing a schematic configuration of a hydraulic pump according to an embodiment of the present invention. Also, FIG. 2 is a cross-sectional view taken along a line A-A of the hydraulic pump shown in FIG. 1. The hydraulic pump shown in FIGS. 1 and 2 converts engine rotation and torque transmitted to a shaft 1 into hydraulic pressure and discharges pressure oil corresponding to a load from a discharge port P2, and is a variable capacity hydraulic pump capable of making a discharge amount of the pump variable by changing a tilt angle a of a swash plate 3.

The hydraulic pump has the shaft 1 rotatably supported by a case 2 and an end cap 8 by means of bearings 9*a* and 9*b*, a cylinder block 6 coupled to the shaft 1 by means of a spline structure 11 to rotate-drive in the case 2 and the end cap 8 so as to be integral with the shaft 1, and the swash plate 3. In the cylinder block 6, a plurality of piston cylinders arranged about an axis of the shaft 1 at regular intervals in a circumferential direction so as to be parallel to the axis of the shaft 1 are provided. A piston 5 capable of reciprocating so as to be parallel to the axis of the shaft 1 is inserted into each of a plurality of piston cylinders.

A tip end of each piston 5 protruding from each piston cylinder is a concave sphere, a shoe 4 is swaged, each piston 5 and each shoe 4 are integrated with each other and each piston 5 and each shoe 4 form a spherical bearing.

The swash plate 3 is provided between a side wall of the case 2 and the cylinder block 6 and has a flat sliding surface S on a side facing the cylinder block 6. Each shoe 4 slides in a circular pattern while being pressed on the sliding surface S in association with rotation of the cylinder block 6, which is linked to rotation of the shaft 1. A spring 15 supported by a ring 14 provided on an inner periphery in an X-direction of the cylinder block 6 and a movable ring 16 and a needle 17 pressed by the spring 15 are arranged about the axis of the shaft 1, and the shoe 4 is pressed against the sliding surface S by a ring-shaped pressing member 18, which abuts on the needle 17.

Two hemispherical bearings 20 and 21, which protrude so as to face the swash plate 3, are provided on the side wall of the case 2 so as to be perpendicular to the axis of the shaft 1 across the same. On the other hand, on a side of the side wall of the case 2 of the swash plate 3, two concave spheres are formed on portions corresponding to arranging positions of the bearings 20 and 21, and a bearing of the swash plate 3 is formed by abutment of the bearings 20 and 21 and the two concave spheres of the swash plate 3. The bearings 20 and 21 are arranged in a Z-axis direction.

The swash plate 3 tilts in a plane parallel to an X-Y plane, as shown in FIG. 2. Tilt of the swash plate 3 is determined by a piston 10, which reciprocates while pressing one end of the swash plate 3 in the X-direction from the side of the side wall of the case 2. The swash plate 3 tilts with the bearings 20 and 21 as supporting points by reciprocation of the piston 10. The sliding surface S also tilts by the tilt of the swash plate 3 and the cylinder block 6 rotates in association with the rotation of the shaft 1, and as shown in FIG. 2, for example, when the cylinder block rotates in a counterclockwise direction as seen in the X-direction when the tilt angle is a, each shoe 4 slides on the sliding surface S in a circular pattern, the piston 5 in each piston cylinder reciprocates in association with this, oil is sucked from a suction port P1 into the piston cylinder through a valve plate 7 when the piston 5 moves to the swash plate 3 side, and the oil in the piston cylinder is discharged from a discharge port P2 as the pressure oil through the valve plate 7 when the piston 5 moves to the valve plate 7 side. Then, a capacity of the pressure oil discharged from the discharge port P2 may be variably controlled by adjusting the tilt of the swash plate 3.

Figure 3:
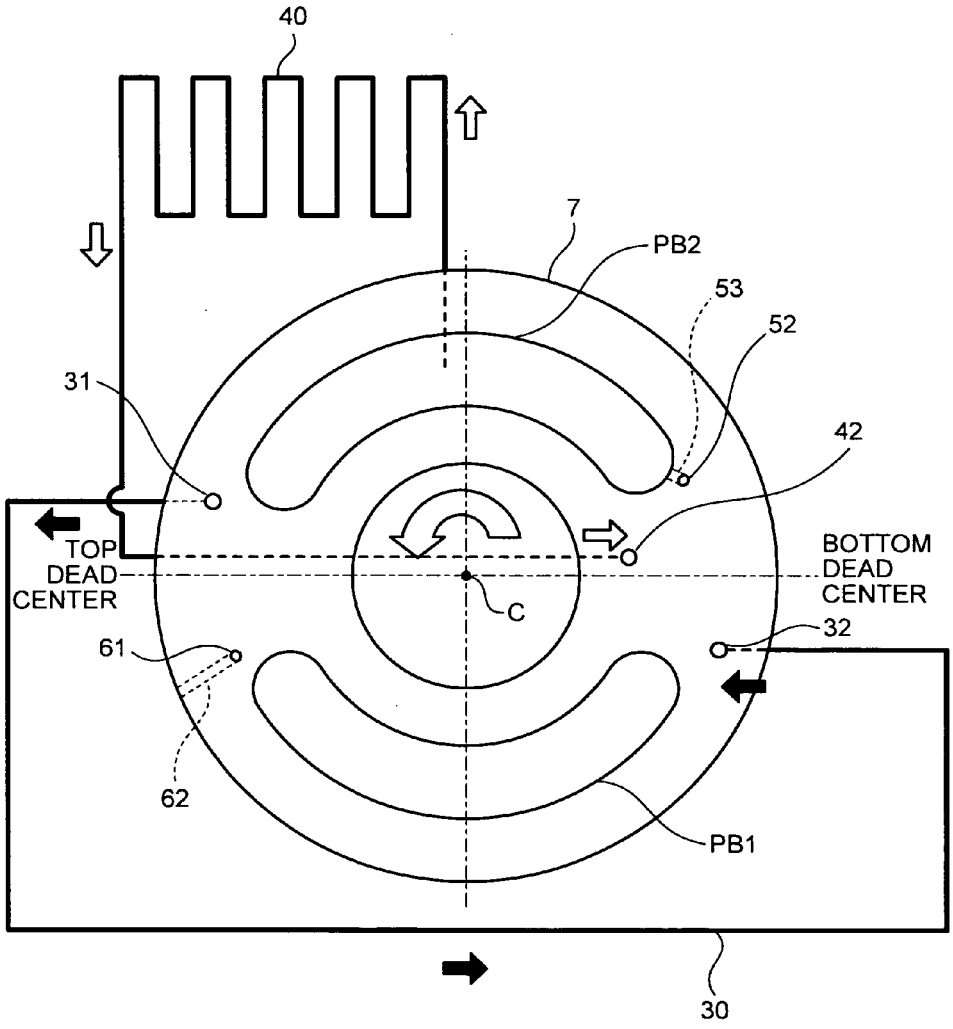
FIG. 3 is a view showing a configuration of a valve plate as seen from a side of a sliding surface of the valve plate and a cylinder block.
Figure 4:
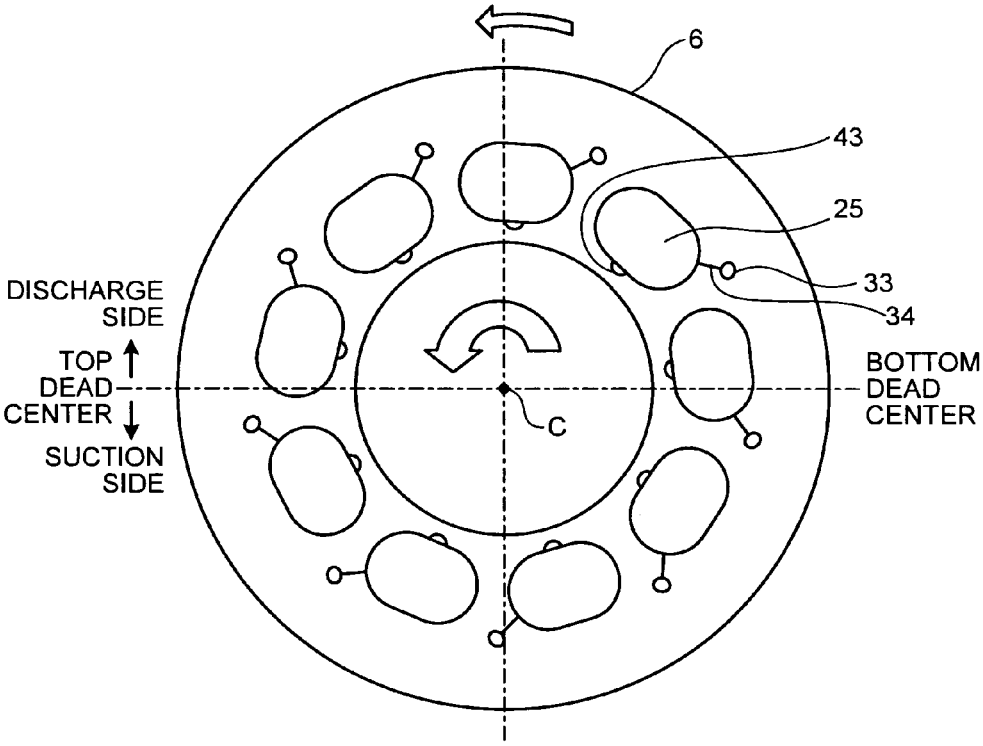
FIG. 4 is a view showing a configuration of the cylinder block in the vicinity of the sliding surface as seen in an X-direction.

Herein, the valve plate 7 fixed on an end cap 8 side and the rotating cylinder block 6 contact each other by means of a sliding surface Sa. FIG. 3 is a view showing a configuration of the valve plate 7 as seen from a sliding surface Sa side. Also, FIG. 4 is a view showing a configuration of the cylinder block 6 in the vicinity of the sliding surface Sa as seen in the X-direction. An end face on the sliding surface Sa side of the valve plate 7 and an end face on the sliding surface Sa side of the cylinder block 6 shown in FIGS. 3 and 4, respectively, contact each other with a rotational axis C of the shaft 1 on the center thereof to form the sliding surface Sa by the rotation of the cylinder block 6.

The valve plate 7 has a valve plate suction port PB1, which communicates with the suction port P1, and a valve plate discharge port PB2, which communicates with the discharge port P2. The valve plate suction port PB1 and the valve plate discharge port PB2 are provided on a same circular arc to form cocoon shapes extending in the circumferential direction. On the other hand, ports of nine cylinder bores 25 in which each piston cylinder 5 reciprocates are provided on the sliding surface Sa side of the cylinder block 6 at regular intervals so as to form the cocoon shapes on the same circular arc on which the valve plate suction port PB1 and the valve plate discharge port PB2 are arranged. Herein, in FIGS. 3 and 4, when the cylinder block 6 rotates in the counterclockwise direction as seen in the X-direction, in FIG. 3, a discharge process is performed on a valve plate discharge port PB2 side on an upper side of a plane of paper and a suction process is performed on a valve plate suction port PB1 side on a lower side of the plane of paper. Therefore, in this case, a left end side of the plane of paper in FIG. 3 is a top dead center at which the process shifts from the discharge process to the suction process and the piston 5 approaches most to the sliding surface Sa side in the cylinder bore 25, and a right end side of the plane of paper in FIG. 3 is a bottom dead center at which the process shifts from the suction process to the discharge process and the piston 5 is most distant from the sliding surface Sa side in the cylinder bore 25. When the cylinder bore 25 passes through the bottom dead center, transition from a low-pressure state to a high-pressure state is made at once.

The cylinder block 6 has a residual pressure loss port 33 provided on a circumference larger than a circumference of an outer side wall surface of the cylinder bore 25 and a position shifted on the circumference from the outer side wall surface of the cylinder bore 25, for example, on a radius, which passes through the middle of the cylinder bore 25. The residual pressure loss port 33 provided on the sliding surface Sa side is provided for each cylinder bore 25 and communicates with the cylinder bore 25 by means of an oblique drilled hole 34, which leads into the cylinder bore 25. Meanwhile, the residual pressure loss port 33 and the drilled hole 34 are provided on positions spaced apart from the outer side wall surface of the cylinder bore 25 so as to avoid a stress generating portion in the vicinity of the outer side wall surface of each cylinder bore 25 in which large stress generates.

On the other hand, on the valve plate 7, a residual pressure loss recovery port 31 is provided on a circumference in the vicinity of the top dead center and on a discharge process side corresponding to the circumference on which the residual pressure loss port 33 is provided and a position to communicate with the cylinder bore 25 immediately after the cylinder bore 25 is freed from communication with the valve plate discharge port PB2. Also, on the valve plate 7, a residual pressure loss regeneration port 32 is provided on a circumference in the vicinity of the bottom dead center and on a suction process side corresponding to the circumference on which the residual pressure loss port 33 is provided and a position to communicate with the cylinder bore 25 immediately after the cylinder bore 25 is freed from communication with the valve plate suction port PB1. Further, on the valve plate 7, a drilled hole as a communication hole for allowing the residual pressure loss recovery port 31 and the residual pressure loss regeneration port 32 to communicate with each other is provided, and a residual pressure loss regeneration circuit 30 having the residual pressure loss recovery port 31 and the residual pressure loss regeneration port 32 is provided. The pressure in the cylinder bore 25 shifting from the suction process to the discharge process is increased by the residual pressure loss regeneration circuit 30.

Also, in the cylinder block 6, a notch groove 43 obtained by obliquely notching in a direction along the cylinder bore 25 in the cylinder bore 25 is provided on an inner circumference of an inner side wall surface of each cylinder bore 25, and the notch groove 43 serves as a port to communicate with the cylinder bore 25 on a plane of the sliding surface Sa.

On the other hand, on the valve plate 7, an oil passage port 42 is provided on a circumference in the vicinity of the bottom dead center and on the discharge process side corresponding to the same circumference as the port of the notch groove 43 and a position to communicate with the cylinder bore 25 before the cylinder bore 25 communicates with the valve plate discharge port PB2. The oil passage port 42 communicates with the valve plate discharge port PB2 through a long passage realized by a long drilled hole and forms an oil passage 40. The passage is provided in the valve plate 7 and the end cap 8, and length thereof is set to be approximately a quarter to a half of a generated pulsation wavelength. The long passage is provided as the oil passage 40 so as to increase inner pressure of the cylinder bore 25 by pressure on a cylinder bore 25 side of the oil passage 40 and allow a decrease in pressure of the oil passage 40 after the increase in pressure to be transmitted to a valve plate discharge port PB2 side after a delay. On the other hand, it may be said that the long passage delays and buffers pressure propagation on the valve plate discharge port PB2 side to make pressure fluctuation of the valve plate discharge port PB2 smaller. Also, the long passage has length capable of restoring the inner pressure on the cylinder bore 25 side to the pressure on the valve plate discharge port PB2 side at the time of non-communication before the communication with the cylinder bore 25 with which this communicates next. Specifically, when a rotational number of the cylinder block 6 is 2000 rpm, the number of cylinder bores 25 is nine and a propagation speed of the pulsation wave is 1000 m/s, the wavelength of the pulsation wave is approximately 3 m. Therefore, when the long passage has the length of a half-wavelength, the length of the oil passage 40 is approximately 1.5 m. However, when the length is set to be not shorter than a full-wave, pressure replenishment to the oil passage 40 by the valve plate discharge port PB2 side is delayed after the pressure propagation to the oil passage port 42 side, and the pressure replenishment to the next cylinder bore 25 is not sufficient. By the oil passage 40, the pressure in the cylinder bore 25 shifting from the suction process to the discharge process is further increased. Meanwhile, a pulsation waveform differs from one hydraulic circuit to another, so that the length of the oil passage 40 has a range from approximately a quarter to a half of the pulsation wavelength. For example, when the pulsation waveform is an ideal sine wave, time (length) from the lowest pressure to the highest pressure is the half-wavelength; however, in the pulsation waveform of an actual hydraulic pump, the time (length) from the lowest pressure to the highest pressure is generally approximately a quarter-wavelength while including small-amplitude fluctuating noise.

Also, on the valve plate 7, a pressure regulating restriction 52 is provided on a circumference through which the cylinder bore 25 passes and a position to communicate with the cylinder bore 25 immediately before the cylinder bore 25 communicates with the valve plate discharge port PB2. In the pressure regulating restriction 52, a port on the sliding surface Sa side and the valve plate discharge port PB2 are communicated with each other by means of an oblique drilled hole 53. The pressure in the cylinder bore 25 shifting from the suction process to the discharge process is further increased by the pressure regulating restriction 52.

Further, on the valve plate 7, a drain port 61 is provided on the circumference through which the cylinder bore 25 passes and a position to communicate with the cylinder bore immediately before the cylinder bore communicates with the valve plate suction port PB1, and the drain port 61 communicates with a space between the valve plate 7 and the case 2 by means of a drilled hole 62. The pressure in the cylinder bore 25 shifting from the discharge process to the suction process is decreased by the drain port 61.

Meanwhile, the pressure in the cylinder bore 25 shifting from the suction process to the discharge process is increased in an order of the residual pressure loss regeneration circuit 30, the oil passage 40 and the pressure regulating restriction 52. Also, each drilled hole is approximately 6 mm in diameter.

Figure 5:
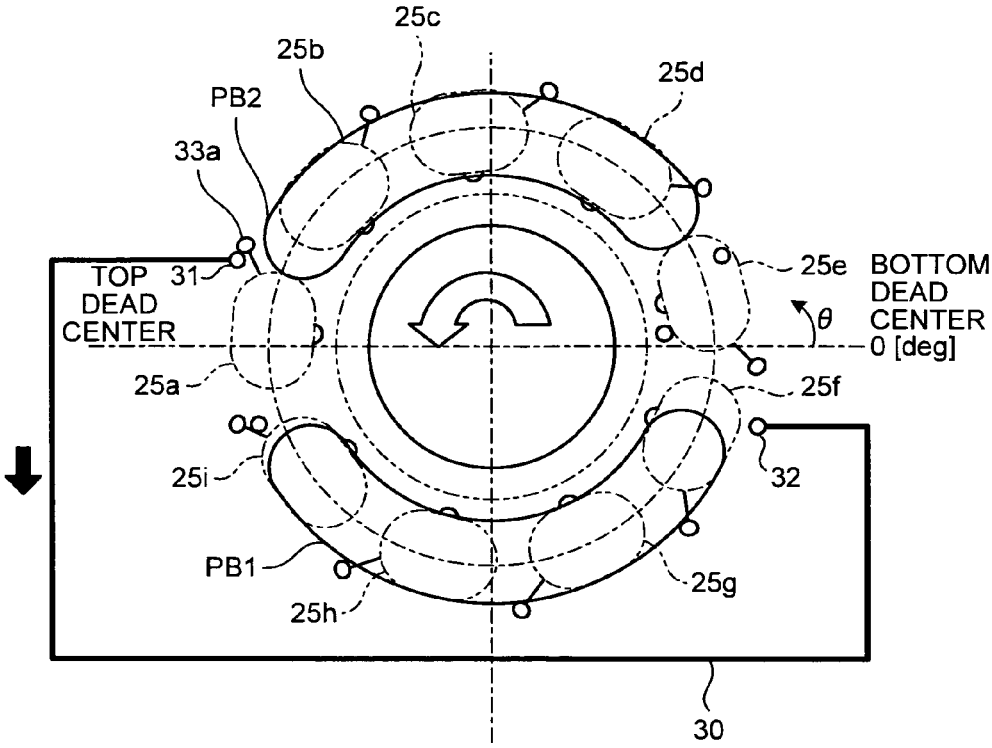
FIG. 5 is a view showing a positional relationship between a cylinder bore and the valve plate immediately before a residual pressure loss regeneration circuit and a residual pressure loss recovery port communicate with each other.

Herein, pulsation preventing operation at the time of operation of the hydraulic pump is described with reference to FIGS. 5 to 8. Meanwhile, as described above, the cylinder bore 25 is such that nine cylinder bores 25*a* to 25*i* are arranged in an annular pattern about the rotational axis. In FIG. 5, this cylinder bores 25*a* to 25*i* rotate in the counterclockwise direction on the drawing. Herein, the discharge process is finished in the cylinder bore 25*a*, and in FIG. 5, the cylinder bore 25*a* is in an arranging state immediately after this is freed from communication with the valve plate discharge port PB2. In this state, an inside of the cylinder bore 25*a* is in a high-pressure state. Then, immediately after this state, the residual pressure loss port 33*a* of the cylinder bore 25*a* communicates with the residual pressure loss recovery port 31 of the residual pressure loss regeneration circuit 30. When the residual pressure loss port 33*a* and the residual pressure loss recovery port 31 communicate with each other, high-pressure operating oil in the cylinder bore 25*a* acts to the drilled hole of the residual pressure loss regeneration circuit 30 and an inside of the drilled hole becomes a high-pressure state. At that time, the residual pressure loss regeneration port 32 of the residual pressure loss regeneration circuit 30 is closed, and this is also closed after the communication between the residual pressure loss port 33*a* and the residual pressure loss recovery port 31 is released, so that the drilled hole of the residual pressure loss regeneration circuit 30 temporarily maintains the high-pressure state. At that time, the cylinder bore 25*f*, which performs the suction process on the bottom dead center side, is finishing the suction process.

Figure 6:
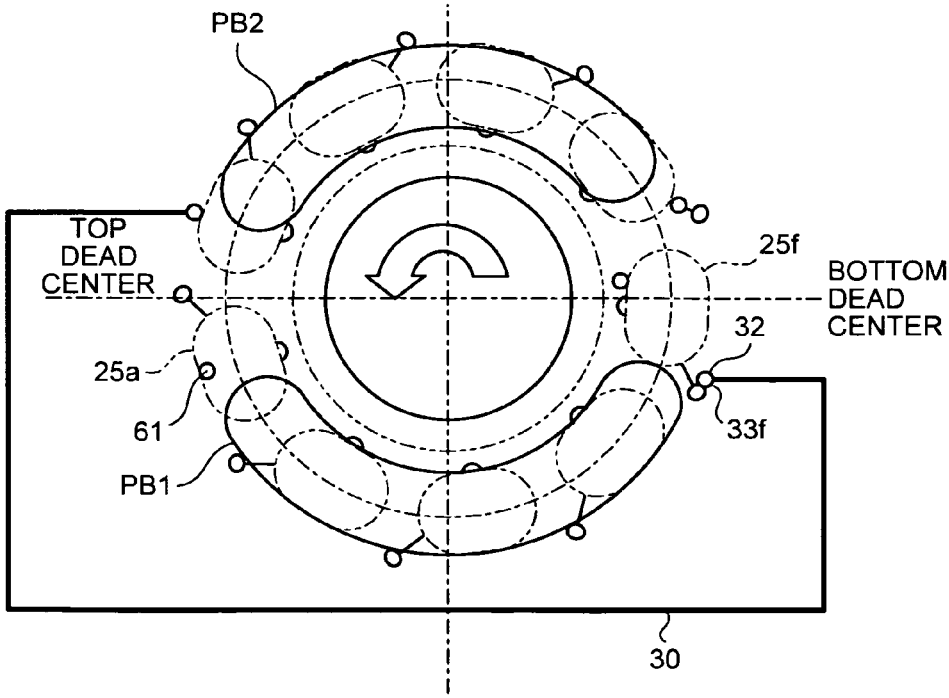
FIG. 6 is a view showing the positional relationship between the cylinder bore and the valve plate immediately before the residual pressure loss regeneration circuit and a residual pressure loss regeneration port communicate with each other.

Thereafter, when the cylinder block 6 further rotates, the cylinder bore 25*a* passes over the top dead center to shift to the suction process, and this communicates with the drain port 61 immediately before the cylinder bore 25*a* communicates with the valve plate suction port PB1, the inner pressure of the cylinder bore 25*a* is returned to atmospheric pressure, and thereafter, this communicates with the valve plate suction port PB1 to start suction operation as shown in FIG. 6.

On the other hand, at that time, as shown in FIG. 6, the cylinder bore 25*f* is just freed from communication with the valve plate suction port PB1 and is in a sealed state and this is on a position immediately before passing over the bottom dead center, and with a finish of the suction operation, the residual pressure loss port 33*f* of the cylinder bore 25*f* is on a position immediately before this communicates with the residual pressure loss regeneration port 32 of the residual pressure loss regeneration circuit 30. Thereafter, the residual pressure loss port 33*f* and the residual pressure loss regeneration port 32 communicates with each other, the pressure is supplied by the cylinder bore 25*a*, and the operating oil in the high-pressure state temporarily accumulated in the drilled hole of the residual pressure loss regeneration circuit 30 increases the inner pressure of the cylinder bore 25*f*. Specifically, the inner pressure of the cylinder bore 25 is increased up to approximately a one-third of discharge pressure of the valve plate discharge port PB2.

Figure 7:
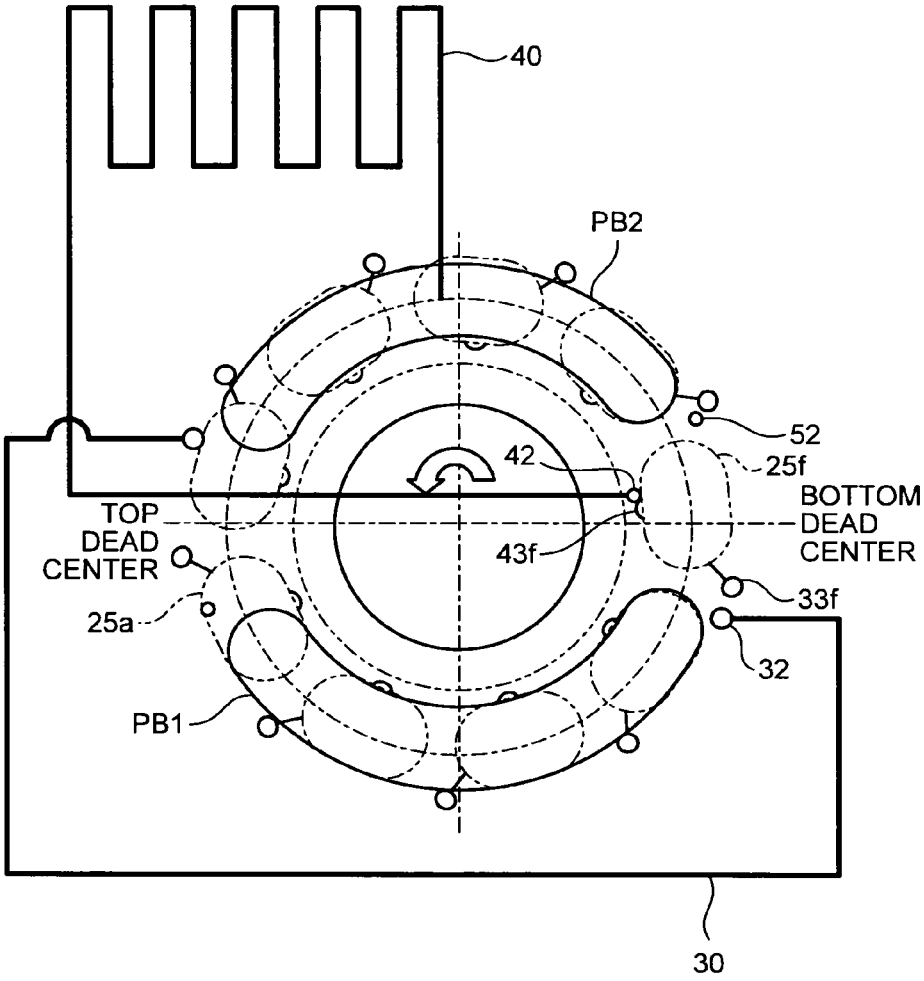
FIG. 7 is a view showing the positional relationship between the cylinder bore and the valve plate immediately before an oil passage circuit and an oil passage port communicate with each other.

Further, when the cylinder block 6 rotates, as shown in FIG. 7, the cylinder bore 25*f* passes over the bottom dead center, and the residual pressure loss port 33*f* of the cylinder bore 25*f* passes over the residual pressure loss regeneration port 32 of the residual pressure loss regeneration circuit 30 to be freed from communication with the same. In this state, the inner pressure of the cylinder bore 25*f* maintains approximately the one-third of the discharge pressure as described above. Further, as shown in FIG. 7, the port of the notch groove 43*f* of the cylinder bore 25*f* and the oil passage port 42 of the oil passage 40 communicate with each other immediately after the residual pressure loss port 33*f* and the residual pressure loss regeneration port 32 are freed from the communication, the discharge pressure is supplied into the cylinder bore 25*f* through the long passage of the oil passage 40 and the inner pressure of the cylinder bore 25*f* is increased. Specifically, the pressure is increased up to approximately the one-third to three-quarters of the discharge pressure.

Figure 8:
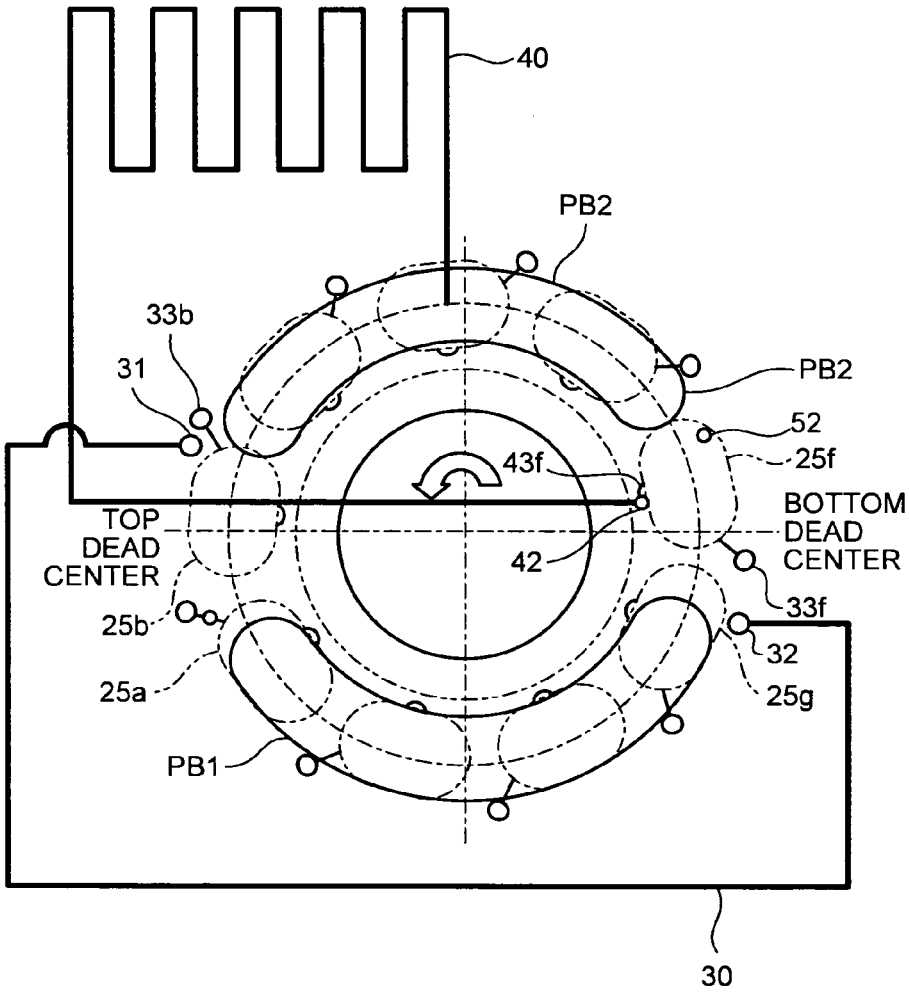
FIG. 8 is a view showing the positional relationship between the cylinder bore and the valve plate immediately before the cylinder bore and a valve plate discharge port communicate with each other.

Thereafter, when the cylinder block 6 further rotates, as shown in FIG. 8, the port of the notch groove 43*f* of the cylinder bore 25*f* passes over the oil passage port 42 and the cylinder block 25*f* is freed from the communication with the oil passage 40. Immediately after that, the cylinder bore 25*f* communicates with the pressure regulating restriction 52 and the discharge pressure is supplied into the cylinder bore 25*f*, and the pressure is increased up to the discharge pressure. Thereafter, the cylinder bore 25*f* communicates with the valve plate discharge port PB2 and discharge operation is started. At a start of the discharge operation, the inner pressure of the cylinder bore 25*f* is increased up to the discharge pressure, so that a counter flow from the valve plate discharge port PB2 is not generated and the pulsation may be inhibited. Meanwhile, each communication of the residual pressure loss regeneration circuit 30, the oil passage 40 and the pressure regulating restriction 52 may be overlapped.

An arrangement of the cylinder bores 25*a* to 25*i* shown in FIG. 8 is the same as a state obtained by moving one cylinder bore in the counterclockwise direction from the arrangement of the cylinder bores 25*a* to 25*i* shown in FIG. 5. Therefore, the above-described process with respect to the cylinder bores 25*a* and 25*f* is repeatedly performed with respect to the cylinder bores 25*b* and 25*g* by the rotation of the cylinder block 6. Therefore, the pulsation generated when all the cylinder bores 25*a* to 25*i* enter into the discharge operation may be inhibited.

Figure 9:
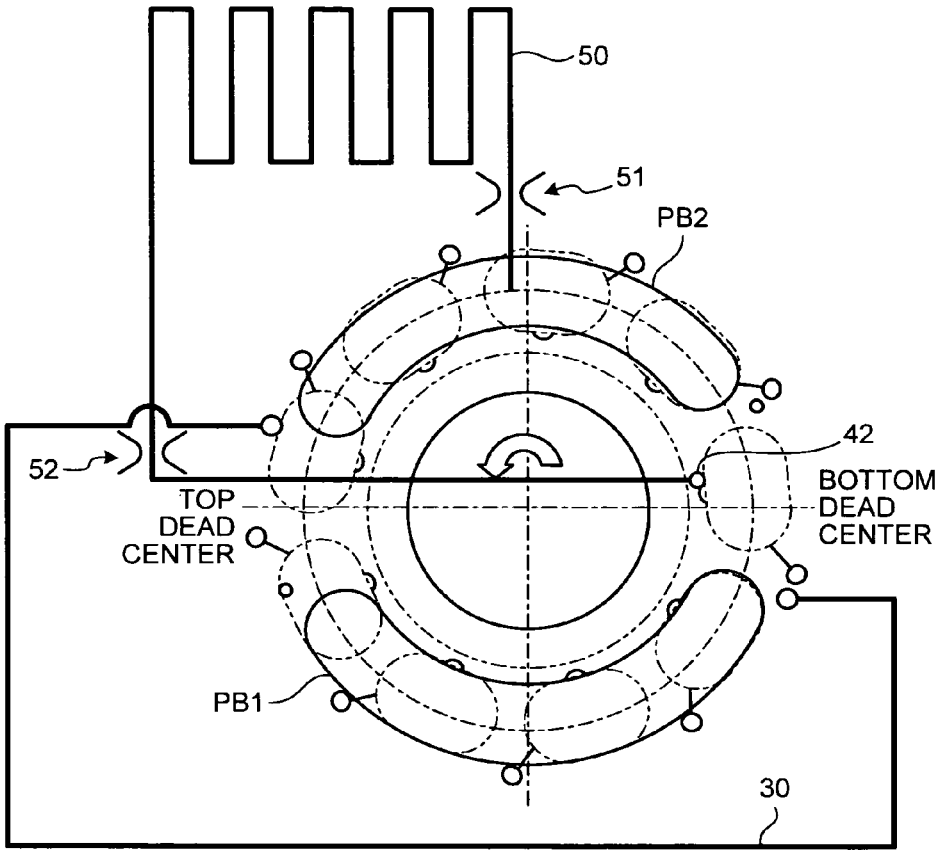
FIG. 9 is a schematic view showing a configuration of a modified example in which a restriction is provided in the oil passage.

Meanwhile, as shown in FIG. 9, restrictions 51 and 52 may be provided on a valve plate discharge port PB2 side and an oil passage port 42 side of an oil passage 50 corresponding to the oil passage 40. By providing the restrictions 51 and 52, phase delay and a temporal buffer effect of the pressure propagation may be obtained, so that pressure propagation adjustment and shortening of the oil passage 50 may be promoted. Meanwhile, the residual pressure loss regeneration circuit 30 also is formed of the drilled hole, so that the restriction may be provided also in the residual pressure loss regeneration circuit 30.

Figure 10:
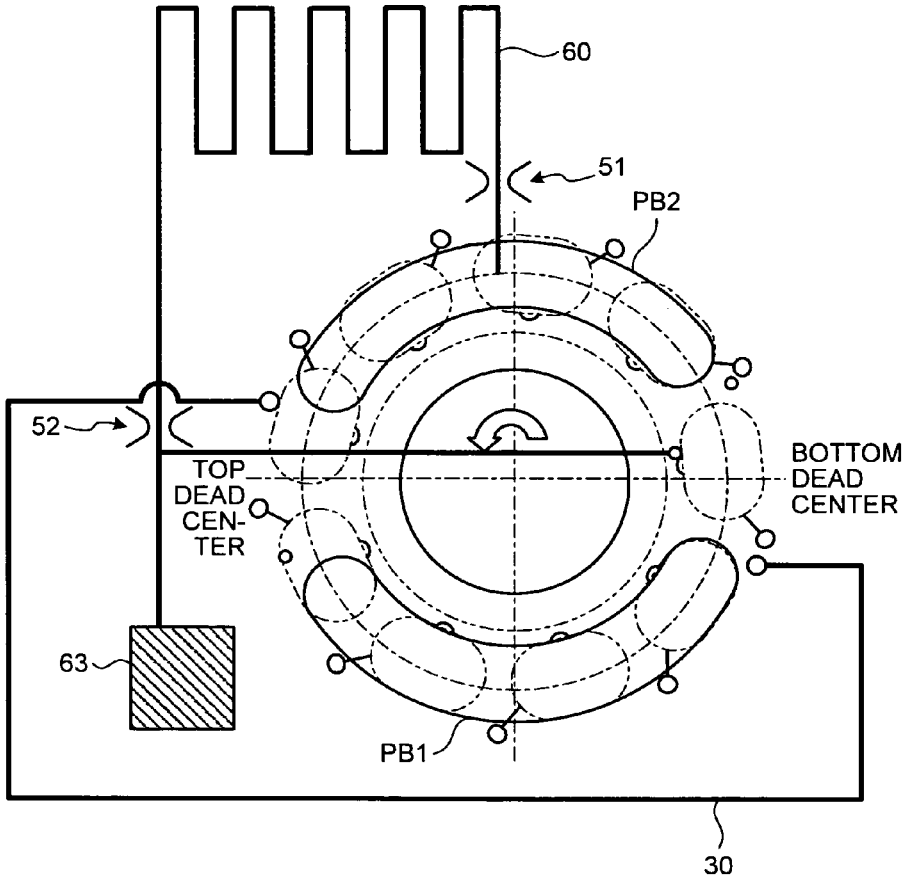
FIG. 10 is a schematic diagram showing a configuration of a modified example in which a volume is provided in the oil passage.

Further, as shown in FIG. 10, a volume 63 having a predetermined volume may be provided in the middle of a long passage of an oil passage 60 corresponding to the oil passage 50. For example, the volume 63 is set to approximately 20 to 200 cc. By providing the volume 63, time when increasing the inner pressure of the cylinder bore may be shortened. As a result, the pressure in the cylinder bore may be increased also at the time of high-speed rotation.

Figure 11:
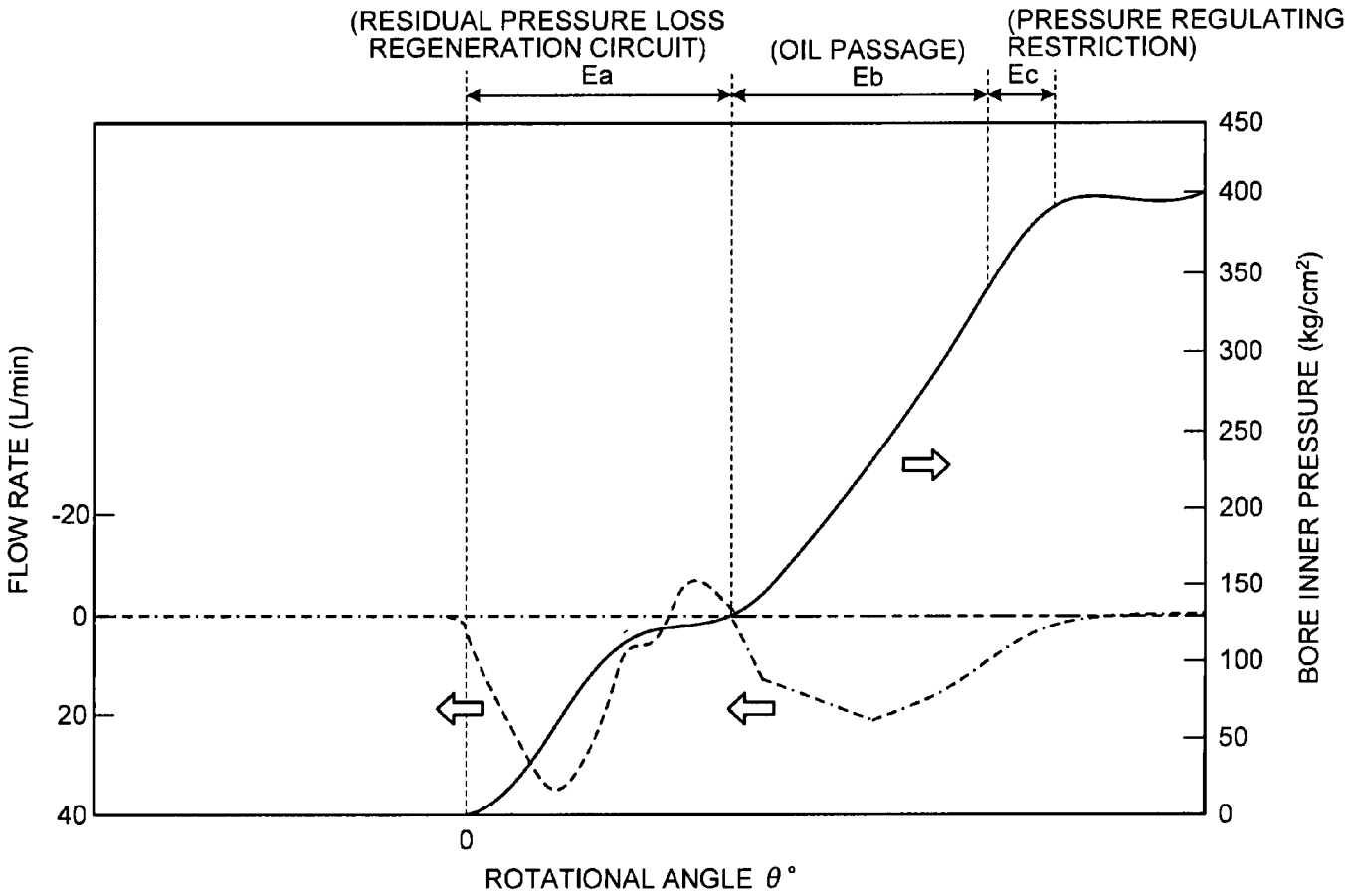
FIG. 11 is a view showing rotational angle dependency of bore inner pressure indicating a pressure-increasing process in the cylinder bore.

Herein, change in bore inner pressure and a flow rate of the operating oil flowing into the bore after the bottom dead center of the cylinder bore associated with the rotation of the cylinder block 6 are described with reference to FIG. 11. Meanwhile, in FIG. 11, a solid line indicates the change in bore inner pressure and a dotted line and a dashed line indicate the flow rate of the operating oil flowing into the bore in which scales are provided in directions indicated by arrows. Also, when a rotational angle θ is 0, the cylinder bore is located on the bottom dead center. First, in a region Ea in which the cylinder bore 25 communicates with the residual pressure loss regeneration circuit 30, the operating oil flows from the residual pressure loss regeneration circuit 30 into the bore at a maximum flow rate of 40 L/min and the bore inner pressure is increased from 0 to 130 kg/cm$^2$. Thereafter, in a region Eb in which the cylinder bore 25 communicates with the oil passage 40, the operating oil flows from the oil passage 40 into the bore at the maximum flow rate of 20 L/min and the bore inner pressure is increased from 130 kg/cm$^2$ to 350 kg/cm$^2$. Thereafter, in a region Ec in which the cylinder bore 25 communicates with the pressure regulating restriction 52, the bore inner pressure is increased from 350 kg/cm$^2$ to 400 kg/cm$^2$ to be substantially the same pressure as the discharge pressure of 400 kg/cm$^2$. In this manner, since the bore inner pressure is gradually increased and the inner pressure of the cylinder bore 25 is unidirectionally increased in the residual-pressure loss regeneration circuit 30 and the oil passage 40, the counter flow from the valve plate discharge port PB2 side may be substantially eliminated when the cylinder bore 25 enters into the discharge operation, so that the pulsation may be inhibited.

Figure 12:
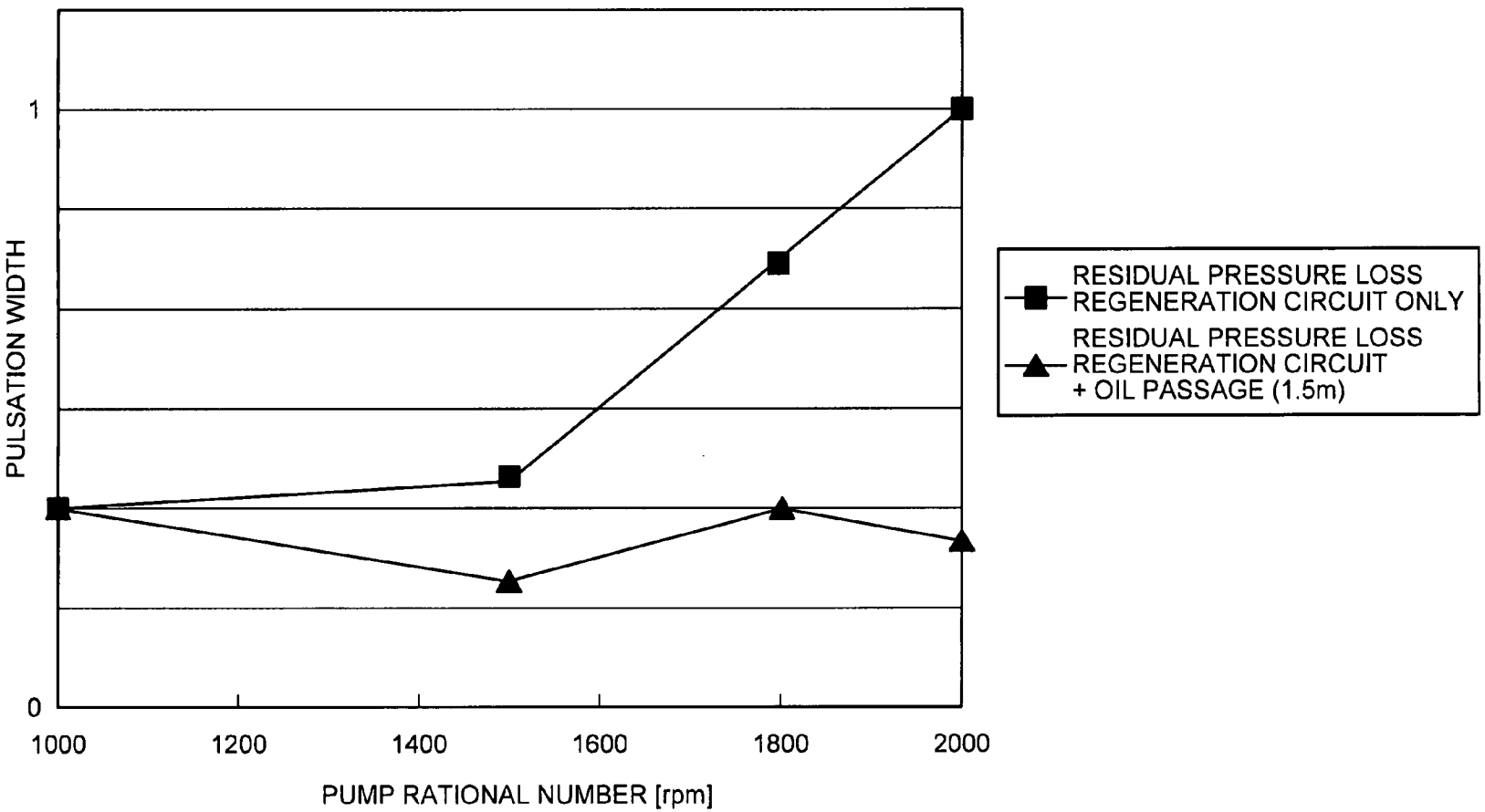
FIG. 12 is a view showing pump rotational number dependency of pulsation width of the embodiment of the present invention and of a conventional example.

Also, in this embodiment, as shown in FIG. 12, the pulsation may be prevented in a wide pump rotational number. That is to say, in FIG. 12, when the pulsation is inhibited using only the residual pressure loss regeneration circuit 30, although the pulsation may be reduced in a region in which the pump rotational number is 1000 to 1500 rpm, the pulsation becomes larger in association with increase in pump rotational number in the region in which the pump rotational number is 1500 to 2000 rpm. On the other hand, in this embodiment using the residual pressure loss regeneration circuit 30 and the oil passage 40, the pulsation may be made smaller in the entire region in which the pump rotational number is 1000 to 2000 rpm.

Figure 13:
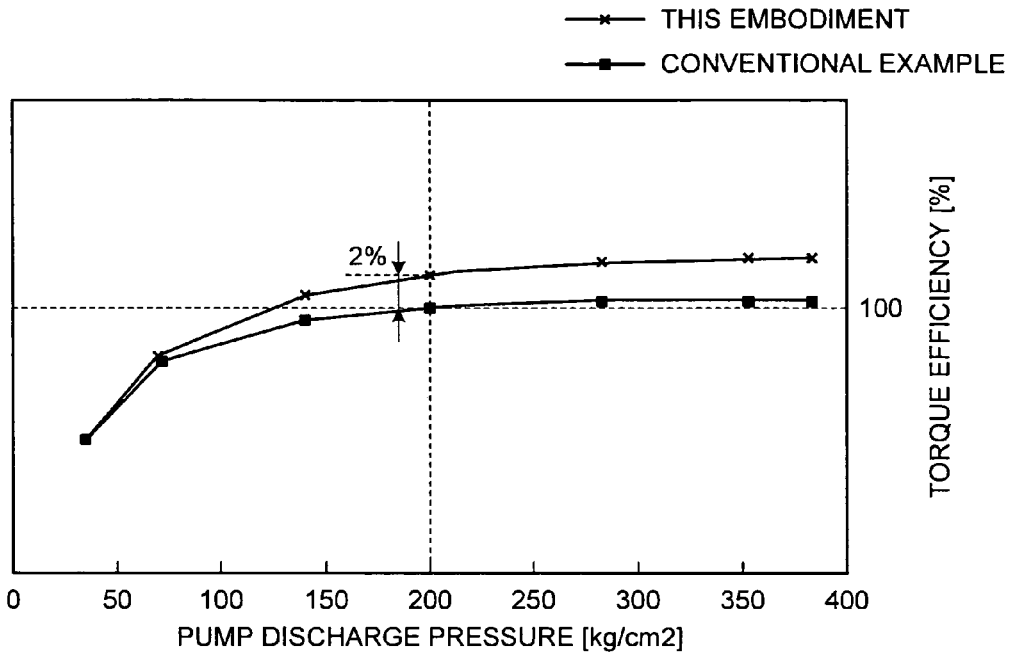
FIG. 13 is a view showing variation in torque efficiency relative to pump discharge pressure.

Further, since the inner pressure of the cylinder bore 25 shifting to the discharge operation is increased using the residual pressure in the cylinder bore 25 in which the discharge operation is finished in this embodiment, as shown in FIG. 13, torque efficiency may be improved than in a conventional case. For example, when the pump discharge pressure is 200 kg/cm$^2$, the torque efficiency may be improved by approximately 2% than in the conventional case. Meanwhile, in FIG. 13, the conventional one has a configuration in which the oil passages 40, 50 and 60 and the residual pressure loss regeneration circuit 30 described in this embodiment are eliminated.

In this embodiment, the inner pressure of the cylinder bore 25*f* shifting from the suction operation to the discharge operation is exclusively and sequentially increased up to the discharge pressure in the order of the residual pressure loss regeneration circuit 30, the oil passage 40 and the pressure regulating restriction 52, so that a drastic counter flow of the discharge pressure into the cylinder bore at the time of the shift to the discharge operation is inhibited, and the pulsation in a wide rotational number range is inhibited.

Meanwhile, although the residual pressure loss regeneration circuit 30 is used in the above-described embodiment, it is possible to use only the oil passages 40, 50 and 60 without using the residual pressure loss regeneration circuit 30. This is because the pressure may be increased only by one oil passage 40 or 50 or 60 and the counter flow is not generated. Herein, since the communication between the cylinder bore 25 and the residual pressure loss recovery port 31 and the communication between the cylinder bore 25 and the residual pressure loss regeneration port 32 are performed at different times in the residual pressure loss regeneration circuit 30 used in this embodiment, this has a delay effect of the pressure propagation and this may be recognized to have substantially the same effect as the oil passages 40, 50 and 60 in this point. Therefore, it is possible to provide a plurality of oil passages using the oil passage having the long passage in place of the residual pressure loss regeneration circuit 30 to sequentially increase the pressure.

Also, although the above-described residual pressure loss regeneration circuit 30 temporarily accumulates the pressure in the drilled hole of the residual pressure loss regeneration circuit 30, a configuration in which the residual pressure loss recovery port 31 and the residual pressure loss regeneration port 32 simultaneously communicate is also possible.

Meanwhile, the configuration in which the residual pressure loss regeneration circuit 30 communicates with the residual pressure loss regeneration port 32 and the oil passage 40 communicates with the oil passage port 42 is described, the configuration is not limited to this, and the configuration in which the residual pressure loss regeneration circuit 30 communicates with the oil passage port 42 and the oil passage 40 communicates with the residual pressure loss regeneration port 32 also is possible. Herein, it is avoided that the residual pressure loss regeneration port 32 and the oil passage port 42 are arranged in the vicinity of an outer peripheral side wall of the cylinder bore 25 in which the stress is highly concentrated, as described above.

Further, although the pressure regulating restriction 52 is used in this embodiment, a notch may be used in place of the same.

Also, width in a radial direction of the valve plate suction port PB1 and width in a radial direction of the cylinder bore 25 are set so as to be substantially the same, and width in a radial direction of the valve plate discharge port PB2 is set to be narrower than the width in the radial direction of the cylinder bore 25 in this embodiment. According to this, a hydraulic balance between suction and discharge may be maintained.

Further, although the hydraulic pump is described as an example in the above-described embodiment, the embodiment is not limited to this and may be applied to a hydraulic motor. In a case of the hydraulic motor, a high-pressure side corresponds to a discharge side of the hydraulic pump and a low-pressure side corresponds to a suction side of the hydraulic pump.

The invention claimed is:

1. An axial hydraulic pump-motor in which a cylinder block having a plurality of cylinder bores formed about a rotational axis slides relative to a valve plate having a high-pressure side port and a low-pressure side port to control an amount of reciprocation of a piston in each cylinder bore by tilt of a swash plate, comprising:

an oil passage for allowing the high-pressure side port and each cylinder bore to temporarily communicate for a first time of bottom dead center non communication after each cylinder bore is freed from communication with the low pressure side port until before each cylinder bore communicates with the high-pressure side port, wherein the oil passage has a length capable of transmitting high pressure in the oil passage to the cylinder bore at the time of communication, and of restoring pressure in the oil passage to a pressure of the high-pressure side port before communication with a next cylinder bore during the first time of bottom dead center non-communication; and a residual pressure loss regeneration circuit extending between a residual pressure loss recovery port and a residual pressure loss regeneration port to transmit pressure from one of the cylinder bore for a second time of top dead center non-communication, wherein when the residual pressure loss recovery port aligns with a residual pressure loss port of such cylinder bore so that the cylinder bore is freed from communication with the high-pressure and low-pressure side ports, the residual pressure loss regeneration circuit receives pressure from such cylinder bore, and the residual pressure loss regeneration circuit passes pressure to another cylinder bore in the first time, when the residual pressure loss regeneration port aligns with the residual pressure loss port of said another cylinder bore when the another cylinder bore is freed from communication with the high-pressure and low-pressure side ports in the first time of the bottom dead center non-communication until the oil passage communicates.

2. The hydraulic pump-motor according to claim 1, wherein the length of the oil passage is approximately a quarter to a half of a wavelength determined by a speed of pressure transmission and frequency of the cylinder bore determined by a rotational speed of the cylinder block.

3. The hydraulic pump-motor according to claim 1, wherein a pressure regulating restriction is provided for allowing each cylinder bore to communicate with the high-pressure side port at a position to communicate with the high-pressure side port and over which the cylinder bore passes.

4. The hydraulic pump-motor according to claim 1, wherein the residual pressure loss recovery port of the residual pressure loss regeneration circuit is provided on a discharge side of the valve plate above top dead center, the residual pressure loss regeneration port is provided on a suction side of the valve plate below bottom dead center and the residual pressure loss regeneration circuit extends between the residual pressure loss recovery port and the residual pressure loss regeneration port, and the residual pressure loss regeneration port is provided at a position to temporarily communicate with the respective cylinder bore after temporal communication between the residual pressure loss recovery port and the respective pressurized cylinder bore.

5. The hydraulic pump-motor according to claim 1, wherein a restriction is provided on the oil passage and/or the residual pressure loss regeneration circuit.

6. The hydraulic pump-motor according to claim 1, wherein the oil passage has a volume for buffering the pressure.

7. The hydraulic pump-motor according to claim 1, wherein the oil passage is at least partially defined by an end cap for holding the valve plate.

8. The hydraulic pump-motor according to claim 1, wherein each cylinder bore communicates with an oblique drilled hole connected to a block port formed in the cylinder block to form a portion of the residual pressure loss regeneration circuit, wherein each block port communicates with the high-pressure side port and the low-pressure side port at different times, and the oil passage includes is a plurality of notch grooves, each notch groove formed in the cylinder block in communication with a respective cylinder bore.

9. The hydraulic pump-motor according to claim 1, comprising:

a plurality of oil passages, wherein each oil passage sequentially communicates with the cylinder bores as rotation of the cylinder block occurs.

10. A method of preventing pulsation of a hydraulic pump-motor for increasing inner pressure of a cylinder bore shifting from a low-pressure suction side to a high-pressure discharge side of a valve plate in an axial hydraulic pump-motor, wherein bottom dead center is defined as mid-point between the low-pressure suction side and the high-pressure suction side of the valve plate in an area in which the cylinder bore transitions from low to high pressure, the axial hydraulic pump-motor having a cylinder block having a plurality of cylinder bores formed about a rotational axis slides relative to the valve plate having a high-pressure side port and a low-pressure side port to control an amount of reciprocation of a piston in each cylinder bore by tilt of a swash plate, comprising:

a first pressure-increasing step for transmitting high pressure in a first cylinder bore of the plurality of cylinder bores on the high-pressure discharge side of the valve plate of top dead center freed from communication with the high-pressure side port to a second cylinder bore of the plurality of cylinder bores on the low-pressure suction side of the valve plate of the bottom dead center freed from communication with the low-pressure side port after the cylinder bore is freed from the communication with the low-pressure side port;

a second pressure-increasing step for transmitting high pressure of the high-pressure side port to the second cylinder bore on a side of the bottom dead center through an oil passage for allowing the high-pressure side port and the second cylinder bore to only temporarily communicate with each other after the first pressure-increasing step and before the second cylinder bore begins communication with the high-pressure side port; and a third pressure-increasing step for transmitting the high pressure of the high-pressure side port to the second cylinder bore by communicating between the cylinder bore on the high-pressure discharge side of the valve plate and the high-pressure side port in a time period after the second pressure-increasing step until before the cylinder bore communicates with the high-pressure side port.

11. A method as recited in claim 10, wherein a pressure in the cylinder bores is approximately equal to a pressure of the high-pressure side port at a start of a discharge operation so that a counter flow from the high-pressure side port is not generated and pulsation associated therewith is inhibited.

12. The hydraulic pump-motor according to claim 1, wherein pressure transfer into the circuit is completed before the pressure in the circuit transmits to another cylinder bore.

13. An axial hydraulic pump-motor in which a cylinder block having a plurality of cylinder bores formed about a rotational axis slides relative to a valve plate having a kidney-shaped high-pressure side port and a kidney-shaped low-pressure side port to control an amount of reciprocation of a piston in each cylinder bore by tilt of a swash plate, wherein: the cylinder bores rotate counterclockwise with respect to the valve plate; a first central location between the side ports where the cylinder bores pass from high-pressure to low-pressure is top dead center; a second central location between the side ports where the cylinder bores pass from low-pressure to high-pressure is bottom dead center; the cylinder bores and side ports are sized and configured such that each cylinder bore is not in communication with either side port approaching and passing away from the dead centers; the valve plate defines an oil passage port near the bottom dead center on the high-pressure side; each bore defines a radially inward notch groove that aligns with the oil passage port as the cylinder bores rotate; the valve plate defines a residual pressure loss recovery port near the top dead center on the high-pressure side; the valve plate defines a residual loss regeneration port near the bottom dead center on the low-pressure side; each bore defines a residual pressure loss port that aligns with the residual pressure loss recovery port and the residual loss regeneration port as the cylinder bores rotate, the pump-motor comprising:

an oil passage for allowing the high-pressure side port and each cylinder bore to temporarily communicate for a time when the notch groove aligns with the oil passage port in a time period of passing through the bottom dead center after each cylinder bore is freed from communication with the low-pressure side port until each cylinder bore communicates with the high-pressure side port, wherein the oil passage has a length capable of transmitting high pressure in the oil passage to the cylinder bore at the time of communication, and of restoring pressure in the oil passage to a pressure of the high-pressure side port before communication with a next cylinder bore during a time of non-communication; and a residual pressure loss regeneration circuit extending between the residual pressure loss recovery port and the residual pressure loss regeneration port to transmit pressure in one of the cylinder bore on a side of a top dead center when the residual pressure loss recovery port aligns with the residual pressure loss port of such cylinder bore so that the cylinder bore is freed from communication with the high-pressure side port to another cylinder bore on a side of a bottom dead center when the residual loss regeneration port aligns with the residual pressure loss port of said another cylinder bore so that the another cylinder bore is freed from communication with the low-pressure side port in a time period after the cylinder bore is freed from the communication with the low-pressure side port until the notch groove of said another cylinder bore aligns with the oil passage port to establish the oil passage.

14. The hydraulic pump-motor according to claim 1, wherein the first time and the second time do not overlap.

15. The hydraulic pump-motor according to claim 1, wherein each cylinder bore includes a notch groove that communicated with the oil passage, the notch grooves being radially inward of the side ports.

16. The hydraulic pump-motor according to claim 1, wherein the residual pressure loss port of each cylinder bore is radially outward of the side ports.

* * * * *